US007244161B2

(12) United States Patent
Thai

(10) Patent No.: US 7,244,161 B2
(45) **Date of Patent: *Jul. 17, 2007**

(54) NON-SPILL CONTAINER

(75) Inventor: Douglas Thai, Walnut, CA (US)

(73) Assignee: Arko Development Limited, Hong Kong (HK)

( * ) Notice: Subject to any disclaimer, the term of this patent is extended or adjusted under 35 U.S.C. 154(b) by 167 days.

This patent is subject to a terminal disclaimer.

(21) Appl. No.: 11/047,005

(22) Filed: Jan. 31, 2005

(65) Prior Publication Data

US 2005/0130552 A1 Jun. 16, 2005

Related U.S. Application Data

(60) Continuation of application No. 10/347,639, filed on Jan. 21, 2003, now Pat. No. 6,857,928, which is a division of application No. 09/847,934, filed on May 3, 2001, now abandoned, which is a continuation-in-part of application No. 09/696,986, filed on Oct. 26, 2000, now Pat. No. 6,638,131, which is a continuation-in-part of application No. 09/562,609, filed on May 1, 2000, now Pat. No. 6,595,822.

(51) Int. Cl.
*A63H 33/28* (2006.01)
*B65D 83/00* (2006.01)
*A47G 19/22* (2006.01)

(52) U.S. Cl. ..... 446/15; 215/388; 220/709; 446/267

(58) Field of Classification Search ..... 220/707–709, 220/254.3, 254.7, 254.1, 252, 254.6, 705, 220/259.1, 259.3, 810, 844, 235; 215/237, 215/364, 388, 389; 222/558, 464.1; 446/15–20, 446/267

See application file for complete search history.

(56) References Cited

U.S. PATENT DOCUMENTS

| | | | | |
|---|---|---|---|---|
| 4,861,303 | A | 8/1989 | Mong-Sheng | |
| 4,874,103 | A | 10/1989 | Quisenberry et al. | |
| 4,957,464 | A | 9/1990 | Perez | |
| 4,988,319 | A | 1/1991 | Shen | |
| 2,560,582 | A | 7/1951 | Limber | |
| 2,659,177 | A | 11/1953 | Kopf | |
| 2,974,438 | A | 3/1961 | Hopkins | |
| 3,262,612 | A * | 7/1966 | Tabor | 220/254.3 |
| 3,420,412 | A | 1/1969 | Greene | |
| 3,485,408 | A | 12/1969 | Binesch | |
| 3,579,898 | A | 5/1971 | Hein | |
| 3,604,144 | A | 9/1971 | Span | |
| 3,736,694 | A | 6/1973 | Lebensfeld | |
| 3,818,627 | A | 6/1974 | Lebensfeld | |
| 4,300,612 | A | 11/1981 | Schroeder, Jr. et al. | |
| 4,423,565 | A | 1/1984 | Bart | |
| 4,700,965 | A | 10/1987 | Kinberg | |
| 4,711,363 | A | 12/1987 | Marino | |
| 4,724,977 | A | 2/1988 | Cleevely et al. | |
| 4,804,346 | A | 2/1989 | Sheng | |

(Continued)

*Primary Examiner*—Eugene Kim
*Assistant Examiner*—Urszula M. Cegielnik
(74) *Attorney, Agent, or Firm*—Raymond Sun

(57) ABSTRACT

A container has a cup-like lower body that receives liquid therein, the lower body having a bottom wall and an open upper mouth. The container also has an inverted cup-like upper body having a top wall and an open lower mouth, and an opening provided in the top wall. The upper body is removably connected to the lower body with the open mouths thereof in communication with each other to form an interior chamber. The container also includes a lid pivotably coupled to the top wall and covering the opening, and a stopper inserted through the opening.

13 Claims, 8 Drawing Sheets

U.S. PATENT DOCUMENTS 5,105,975 A 4/1992 Patterson
5,230,648 A 7/1993 Kelly et al.
5,259,538 A 11/1993 Tardif
5,262,757 A 11/1993 Hansen
5,273,172 A 12/1993 Rossbach et al.
5,304,085 A 4/1994 Novak
5,361,934 A 11/1994 Spence, Jr.
5,395,274 A 3/1995 Myers
5,465,866 A 11/1995 Belcastro
5,498,191 A 3/1996 De Mars
5,509,551 A 4/1996 Terrell, II
5,513,762 A 5/1996 Janani
5,542,869 A 8/1996 Petty
5,579,948 A 12/1996 Lin
5,582,333 A 12/1996 Bennett
5,607,086 A 3/1997 Gooch
5,613,890 A 3/1997 De Mars
5,653,620 A 8/1997 Lin
5,702,020 A 12/1997 Larsen
5,806,765 A * 9/1998 Weinstein ..... 215/388
5,839,936 A 11/1998 Lin
5,850,945 A 12/1998 Frankel
RE36,131 E 3/1999 Schramm
5,879,218 A 3/1999 Tao
5,897,013 A 4/1999 Manganiello
6,050,433 A 4/2000 Russell et al.
6,062,935 A 5/2000 Gross
6,132,125 A 10/2000 Lin
6,135,842 A 10/2000 La Fata
6,149,486 A 11/2000 Thai
6,170,719 B1 1/2001 Wilkinson et al.
6,200,184 B1 3/2001 Rich et al.
6,331,130 B1 12/2001 Thai
6,343,712 B1 2/2002 Flackett et al.
6,447,356 B1 9/2002 Lapointe
6,530,815 B1 3/2003 Bro et al.
6,595,822 B1 7/2003 Thai
6,638,131 B1 10/2003 Thai

* cited by examiner

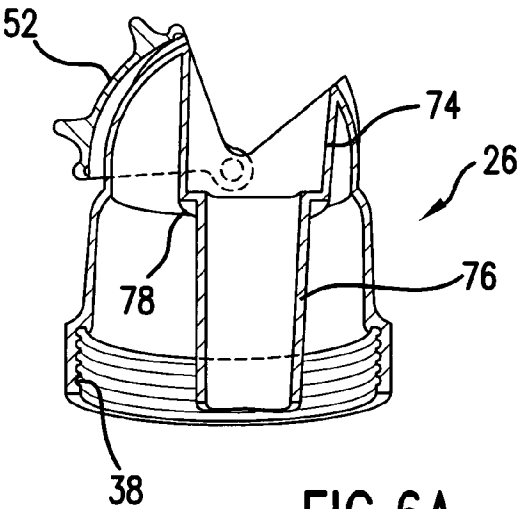
FIG.6A
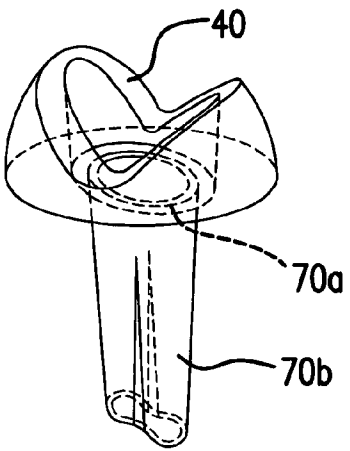
FIG.6B
FIG.5A
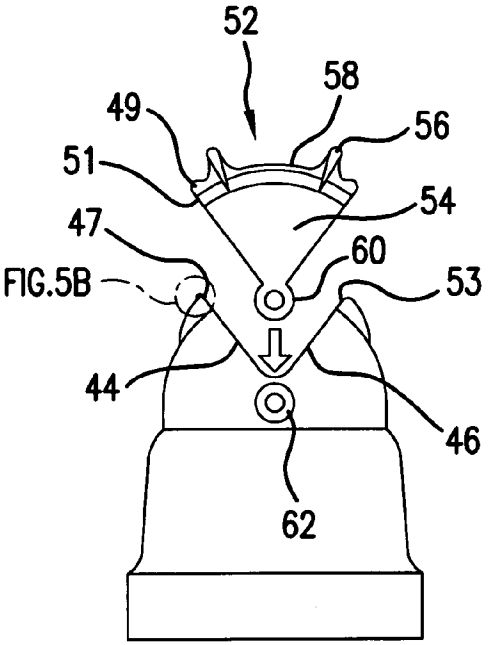
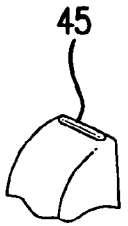
FIG.5B

NON-SPILL CONTAINER

RELATED CASES

This is a continuation of Ser. No. 10/347,639, filed Jan. 21, 2003 now U.S. Pat. No. 6,857,928, which is a division of Ser. No. 09/847,934, filed May 3, 2001, entitled "Non-Spill Container", now abandoned, which is a continuation-in-part of Ser. No. 09/696,986, entitled "Non-Spill Container", filed Oct. 26, 2000, now U.S. Pat. No. 6,638,131, which is in turn a continuation-in-part of Ser. No. 09/562,609, entitled "Non-Spill Container", filed May 1, 2000, now U.S. Pat. No. 6,595,822, whose disclosures are incorporated by this reference as though fully set forth herein.

BACKGROUND OF THE INVENTION

1. Field of the Invention

The present invention relates to liquid containers, and in particular, to a non-spill container.

2. Description of the Related Art

Bubble producing toys and devices are very popular with children. A wide variety of such bubble producing toys are now available in the market. Despite this widespread variety, the most basic form of a bubble producing toy is a wand that has a handle at one end and a loop at a second end. The loop is dipped into a bubble solution (which is usually soap) so that a film of the bubble solution extends across the area of the loop. The child can then blow at the loop to create bubbles.

The use of this wand and its loop requires that the loop be continuously dipped into the bubble solution to create more bubbles. Therefore, the container for the bubble solution must provide sufficiently convenient access to the user for continuous dipping of the wand and its loop.

Another important characteristic that the bubble solution container must have is that it should guard against spills. Since most bubble solution is made from soap, spills can be very messy. A number of spill-proof or non-spill containers have been provided to guard against spills of liquids stored therein. An example of a non-spill container is illustrated in U.S. Pat. No. 5,105,975 to Patterson, which provides a top member that is releasably mounted to a bottom member. A tube extends through an opening in the top member. The volume of the bottom member is provided to be smaller than the volume of the top member so that the liquid contained in the bottom member is prevented from entering the tube when the container is tipped. Unfortunately, the container in U.S. Pat. No. 5,105,975 is not completely spill-proof, and leakage is still possible.

In light of the above, there still remains a need for a container that effectively prevents the liquid stored therein from being spilled, yet provides convenient access to the liquid stored therein.

SUMMARY OF THE INVENTION

It is therefore an object of the present invention to provide a container that effectively prevents the liquid stored therein from being spilled.

It is another object of the present invention to provide a container that provides convenient continuous access to the liquid stored therein.

The objects of the present invention may be achieved by providing a container having a cup-like lower body that receives liquid therein, and having a bottom wall and an open upper mouth. The container also has an inverted cup-like upper body having a top wall and an open lower mouth, and an opening provided in the top wall. The upper body is removably connected to the lower body with the open mouths thereof in communication with each other to form an interior chamber. The container also includes a lid pivotably coupled to the top wall and covering the opening, and a stopper inserted through the opening.

Thus, the pivotable lid covers the opening, and retains the stopper securely in place so as to prevent liquid from exiting through the opening. The stopper can be easily and conveniently removed from the opening to allow the user with quick and convenient access to the liquid stored in the interior of the container.

BRIEF DESCRIPTION OF THE DRAWINGS

FIG. 5A is an enlarged exploded view of the lid of the container of FIGS. 1–4.

FIG. 5B is an enlarged sectional view of the circled region in FIG. 5A.

FIG. 6A is a cross-sectional view of the upper portion of the container of FIGS. 1–4 shown with the lid in the opened position.

FIG. 6B is a perspective sectional view of another embodiment of the upper portion of the container of FIGS. 1–4.

DESCRIPTION OF THE PREFERRED EMBODIMENTS

Figure 2:
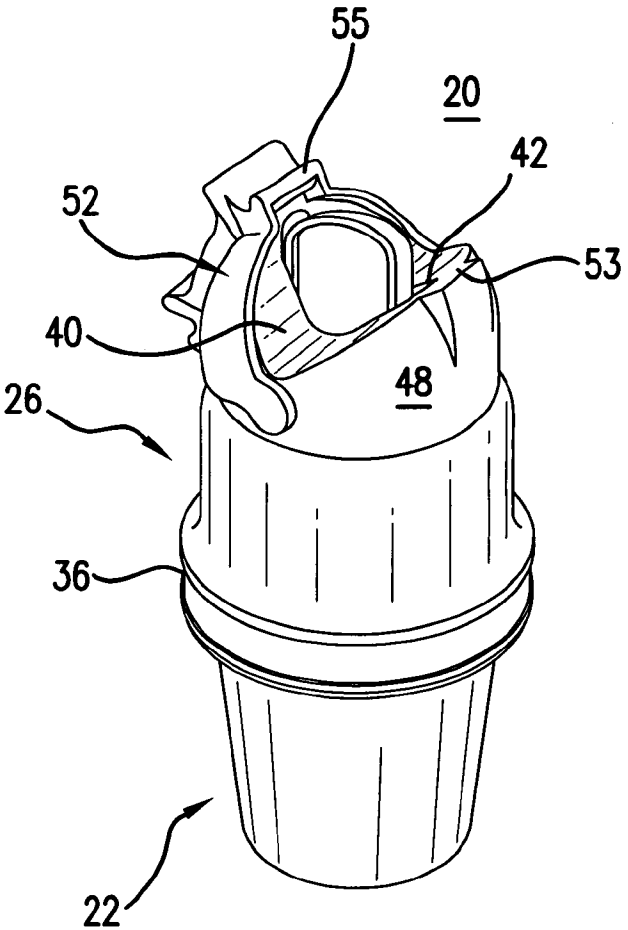
FIG. 2 is a perspective view of the container of FIG. 1 shown with the lid in the opened position.
Figure 1:
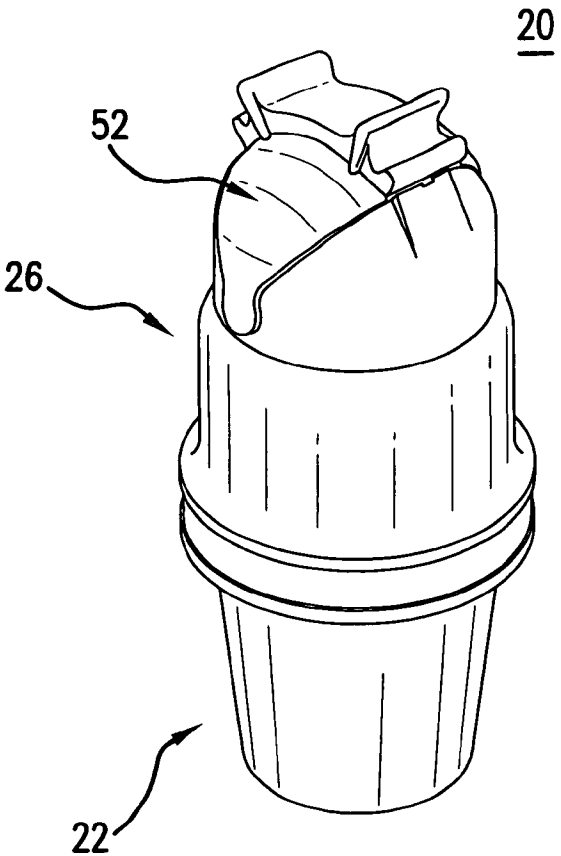
FIG. 1 is a perspective view of a non-spill container according to one embodiment of the present invention shown with the lid in the closed position.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The present invention is applicable to all containers that hold or otherwise retain liquid. Such containers can be used to hold any type of liquid, where the liquid needs to be dispensed using a wand, a tong, or other dispensing device. Thus, the container can be used to hold bubble solution for use with a bubble producing toy, or it can be used to hold medicine, detergent or other liquids.

The present invention provides different embodiments of non-spill containers having an opening through which a stopper may be inserted. A pivotable lid is positioned over the opening to cover the opening, and to retain the stopper securely in place so as to prevent the liquid from exiting through the opening. The stopper can be easily and conveniently removed from the opening to allow the user with quick and convenient access to the liquid stored in the interior of the container.

FIGS. 1–8 illustrate one embodiment of a non-spill container 20 according to the present invention. The container 20 has a lower body 22 defining an interior chamber 24, and an upper body 26 that is removably connected to the lower body 22. The lower body 22 is cup-like in that it is generally cylindrical, has an open mouth and has a bottom wall 28. The top 30 of the lower body 22 has an upper annular flared rim 32 having external threads 34, with the upper flared rim 32 defining the open mouth.

Figure 4:
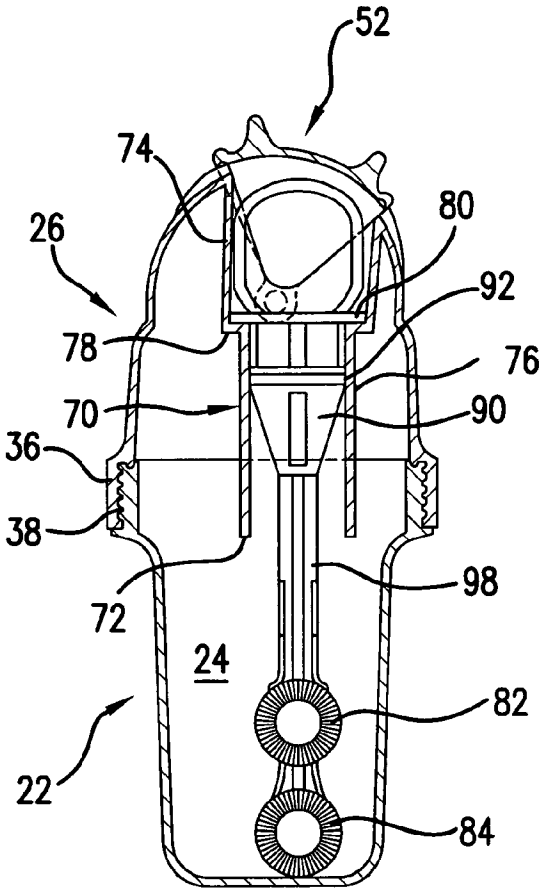
FIG. 4 is a side cross-sectional view of the container of FIG. 1.
Figure 7:
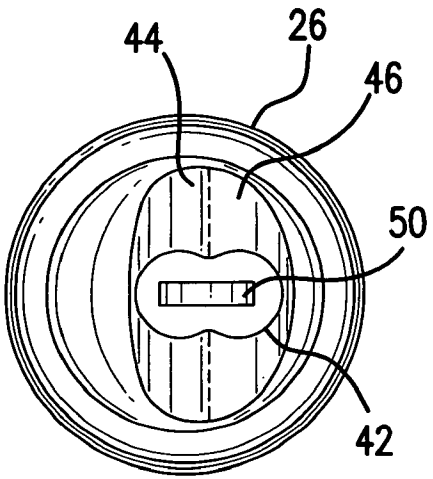
FIG. 7 is a top plan view of the container of FIGS. 1–4 with the lid opened.

The upper body 26 is also generally cylindrical with an inverted cup-like configuration, and has a lower annular flared rim 36 that has internal threads 38. The lower flared rim 36 has a slightly larger diameter than the upper flared rim 32 so that the lower flared rim 32 of the lower body 22 can be received inside the upper flared rim 36 of the upper body 26. The top of the upper body 26 has a rounded surface 48, similar to a hemisphere. The upper body 26 also has a top wall 40 that can have either a generally concave or a V-shaped configuration, with an elongated opening 42 provided in the top wall 40. The V-shaped or concave configuration of the top wall 40 has a first inclined surface (which can be curved) 44 and a second inclined surface (which can be curved) 46. The elongate opening 42 extends across both inclined surfaces 44 and 46, and as best shown in FIG. 4, is offset from the center of the upper body 26. The elongate opening 42 is adapted to receive a 30 stopper 50, as explained in greater detail below. In one non-limiting embodiment, the elongate opening 42 has a Figure-8 configuration, as best shown in FIG. 7. A raised ridge 45 is provided along an upper extremity 47 of an inclined surface 44, and is adapted to snap into an inner channel 49 provided at the rear-most end 51 of a rounded top wall 58 of a lid 52, so as to secure the lid 52 in the closed position. The upper extremity 53 of the other inclined surface 46 acts as a stop surface for the front-most end 55 of the rounded top wall 58 of the lid 52.

A lid 52 is pivotably secured to the upper body 26 and positioned above the top wall 40 to cover the top wall 40 and the elongate opening 42 (and its stopper 50, if inserted). The lid 52 has two side walls 54 that are connected by the rounded top wall 58. Ridges or bumps 56 can be provided on top of the rounded top wall 58 to facilitate gripping or pushing action by the user. Each side wall 54 has a rounded lower point 60. Pivot points 62 can be provided on opposite sides of the upper body 26 adjacent the top thereof. A small bearing point (not shown) is provided between each pivot point 62 and the corresponding rounded lower point 60 to allow the points 60 of the lid 52 to pivot about these pivot points 62 from a completely closed position, shown in FIG. 1, in which the lid 52 completely encloses the top wall 40 and the stopper 50, to a completely opened position, shown in FIG. 2, in which the lid 52 is slid and seated over a portion of the rounded surface 48 to expose the stopper 50. When the lid 52 is in the closed position, the lid 52 can be snapped into locking engagement with the upper body 26 by snap-fitting the ridge 45 into the channel 49 of the lid 52. The stop surface 53 contacts the front-most end 55 of the rounded top wall 58 to define the limit to which the lid 52 can be pivoted.

Figure 3:
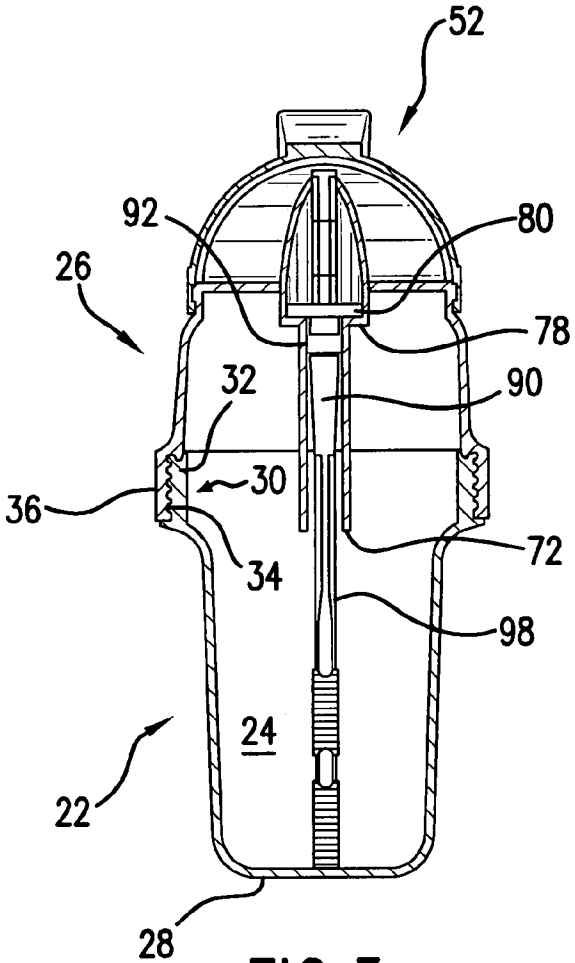
FIG. 3 is a front cross-sectional view of the container of FIG. 1.

A tube or funnel 70 extends from the opening 42 in the top wall 40 into the interior of the upper body 26. The tube 70 functions as a guide for the stopper 50. The tube 70 has an upper section 74 which has a larger dimension than a lower section 76. The upper section 74 has a ledge surface 78 that is adapted to engage or receive an extension 80 of the stopper 50. The upper section 74 and lower section 76 of the tube 70 can have a generally Figure-8 cross-sectional configuration that is adapted to receive the generally Figure-8 cross-section of certain portions of the stopper 50. Even though the tube 70 is illustrated as being generally Figure-8 in cross-section, it is possible to provide the cross-section of the tube 70 in any desired configuration. For example, the cross-sectional configuration of the tube 70 can be Figure-8 throughout the length of the tube 70 (as shown in FIGS. 6A and 7). Alternatively, as shown in FIG. 6B, the cross-sectional configuration of the tube 70 can change, such as from a generally oval cross-section at the top (see 70*a*) adjacent the opening 42, and then gradually transition into a Figure-8 cross-section (see 70*b*) as the tube 70 extends into the interior of the container 20. The tube 70 can also extend for any desired length into the interior of the container 20. For example, as shown in FIGS. 3 and 4, the tube 70 can extend for a length that is about the same as the length of the upper body 26, so that the lowermost end 72 of the tube 70 extends to the region where the rims 32 and 36 are located. Alternatively, the tube 70 can extend for a length that is less than the length of the upper body 26, or for a length that is greater than the length of the upper body 26 so that the lowermost end 72 is positioned inside the interior chamber 24 of the lower body 22.

The lower body 22 and the upper body 26 can be made from the same material, or from different materials. Possible materials for the lower body 22 and the upper body 26 can include plastic, acrylic, metal, glass or certain fabrics. The tube 70 can be molded or provided in one piece together with the upper body 26. The lid 52 can be made from a plastic or metal material, and then pivotably secured to the pivot points 62.

Figure 9A:
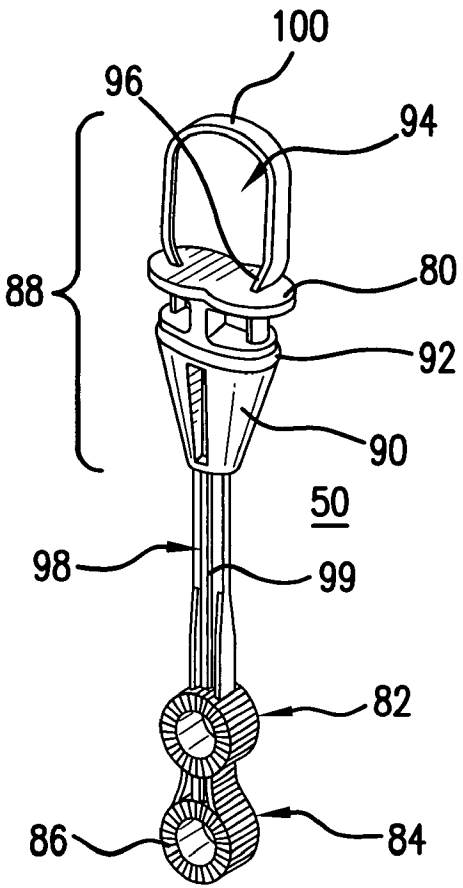
FIG. 9A is a perspective view of one stopper that may be used with the container of FIGS. 1–4.

The stopper 50 as shown in FIGS. 1–7 is a bubble producing toy 50 (also referred to herein as a "wand"), and is illustrated in greater detail in FIG. 9A. The wand 50 has a thin shaft 98 that is generally rectangularly-shaped with a shallow groove 99 extending along the shaft 98. A plurality of ring-like loops 82, 84 are provided at a first end of the shaft 98. Each loop 82, 84 has a serratted ring, such that ridges or bumps 86 are provided on the outer surfaces of the loop 82, 84. The ridges 86 function to hold the bubble solution against the loop 82, 84 to form a solution film that is blown to form the bubbles. The loop 82, 84 can have any desired shape, and any number of loops 82, 84 can be provided. The groove 99 functions to guide bubble solution downwardly towards the loops 82, 84 so as to further concentrate the bubble solution at the loops 82, 84. The opposing (i.e., second) end of the shaft 98 has a support section 88 that includes a shoulder 90, a lining 92, an enlarged gripping handle 94, and the extension 80. Specifically, the shoulder 90 is generally triangular and is provided adjacent the second end of the shaft 98. The lining 92 is provided above the shoulder 90 and functions like a gasket to prevent the liquid stored in the interior chamber 24 from passing therethrough. In the embodiment of FIG. 9A, the shoulder 90 and lining 92 can have a generally oval cross-sectional configuration. The lining 92 can be made from rubber, plastic and certain fabrics. The extension 80 is provided above the lining 92, and can be provided in a generally Figure-8 configuration and extends radially outwardly. The handle 94 can be a thin plate that is positioned above the extension 80, and has an angled lower edge 96 adjacent the extension 80.

Although the bubble producing toy 50 is illustrated as being inserted through the opening 42 to act as a stopper, other stoppers can also be used to seal the opening 42. For example, the stopper can have the same configuration as the bubble producing toy 50 (i.e., including the shaft 98, the shoulder 90, the lining 92, the enlarged gripping handle 94, and the extension 80), but with the loops 82, 84 omitted. With the loops 82, 84 omitted, the shaft 98 can be provided as a hollow tube with the lower end opened, so that the stopper can then be used as a bulb or syringe for drawing medicine stored in the container 20.

Figure 8:
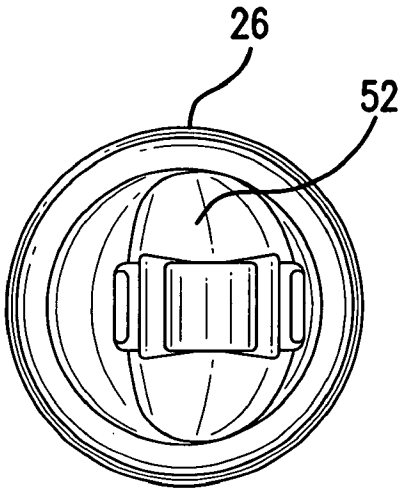
FIG. 8 is a top plan view of the container of FIGS. 1–4 with the lid covering the opening.
Figure 9C:
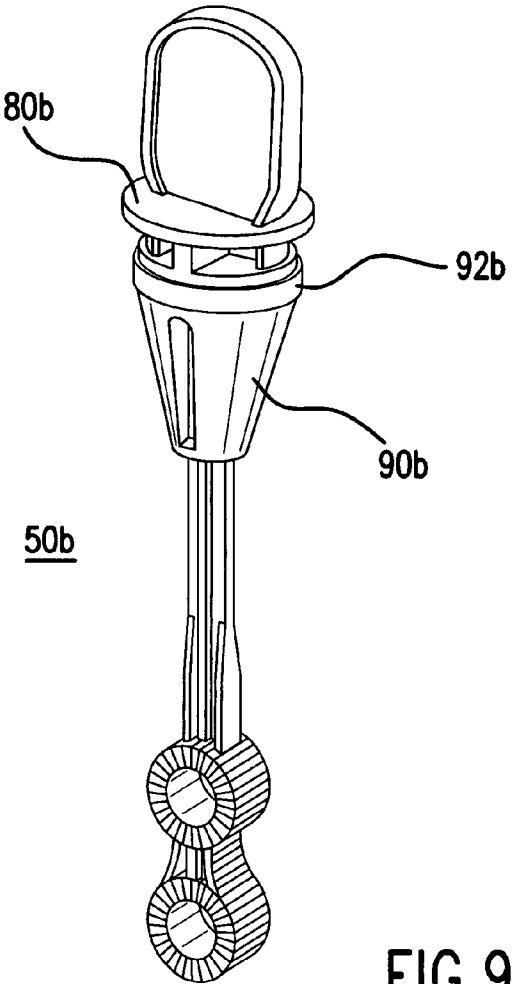
FIG. 9C is a perspective view of yet another stopper that may be used with the container of FIGS. 1–4.
Figure 9B:
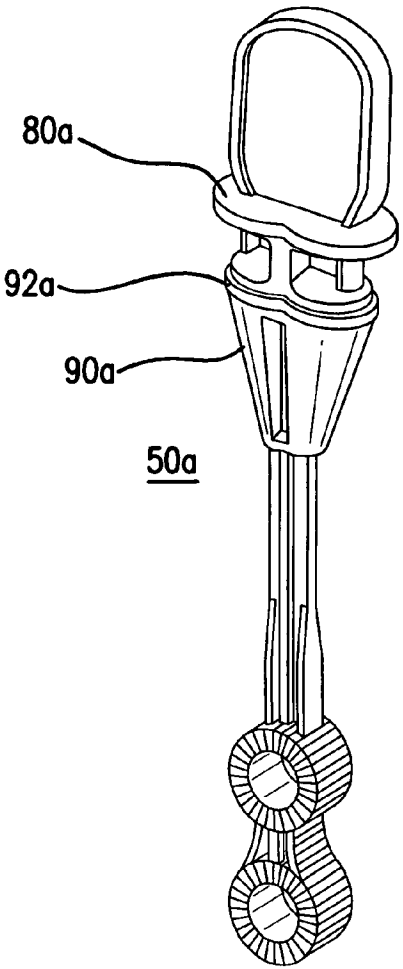
FIG. 9B is a perspective view of another stopper that may be used with the container of FIGS. 1–4.

FIG. 9B illustrates modifications that can be made to the stopper 50 of FIG. 9A. In FIG. 9B, the stopper 50*a* is the same as the stopper 50, except that the shoulder 90*a* and the lining 92*a* also have a Figure-8 configuration. Thus, depending on the actual cross-sectional configuration of the tube 70, either stopper 50 or 50*a* can be used to optimize the convenience to the user (of inserting and removing the stopper) and to prevent spillage of the liquid. For example, the stopper 50*a* having a Figure-8 extension 80*a* and a Figure-8 lining 92*a* would be more effective in sealing the entire tube 70 in FIGS. 1–8 since the entire tube 70 has a Figure-8 cross-sectional configuration.

FIG. 9C illustrates further modifications that can be made to the stopper 50 of FIG. 9A. In FIG. 9C, the stopper 50*b* is the same as the stopper 50, except that the extension 80*b*, the shoulder 90*b* and the lining 92*b* have a circular configuration.

In operation, the lower body 22 and upper body 26 are provided separately. Any liquid (e.g., bubble solution) can be filled into the interior chamber 24, and then the upper body 26 connected to the lower body 22 by engaging the threads 34 and 38 of the flared rims 32 and 36, respectively. The lid 52 is now pivoted to the opened position shown in FIG. 2. The wand 50 is then inserted through the opening 42 so that the loops 82, 84 and a lower portion of the shaft 98 extend through the tube 70 and into the interior chamber 24 of the lower body 22, with the shoulder 90 and the lining 92 retained inside the lower section 76 of the tube 70 (see FIGS. 3 and 4). Preferably, the lining 92 will have the same configuration as the cross-section of the lower section 76 of the tube 70 (e.g., both the lining 92 and the lower section 76 are Figure-8, or both are oval, for example). At this time, the extension 80 will engage the ledge surface 78, which acts as a stop surface to prevent the wand 50 from being inserted any further into the opening 42. A portion of the handle 94 is retained inside the upper section 74 of the tube 70 (see FIGS. 2–4). At this time, the provision of the lining 92 inside the tube 70, coupled with the extension 80 engaging and covering the ledge surface 78, will prevent the liquid inside the container 20 from being leaked or spilled via the tube 70 and the opening 42. The lid 52 can now be pivoted to its closed position shown in FIG. 1, with the rounded top wall 58 covering the wand 50, and more particularly, engaging the top edge 100 of the handle 94 to keep the support section 88 securely positioned over the opening 42 as a further safeguard against leakage through the opening 42.

Where the tube 70 is provided with a changing cross-sectional configuration (e.g., from oval to Figure-8), the oval portion of the tube 70 will facilitate easier insertion of the loops 82, 84 and shaft 98, while the Figure-8 portion will provide a more secure (e.g., narrow) fit of the stopper 50 inside the tube 70 to minimize the possibility of the stopper 50 coming loose. This feature further minimizes spillage or leakage of liquid stored inside the container 20.

To access the liquid stored inside the container 20, the user merely flips (i.e., pivots) open the lid 52 to the opened position shown in FIG. 2 by pushing on any bump 56. The user then grips the handle 94, and lifts the wand 50. If the liquid is a bubble solution, then the user can insert the wand 50 back through the opening 42 to access more of the bubble solution to create more bubbles. If the liquid is a medicine, the user can insert the medicine stopper 50 back through the opening 42 to access more of the medicine.

FIGS. 10–16 illustrate another embodiment of a non-spill container 120 according to the present invention. The container 120 has a lower body 122 defining an interior chamber 124, and an upper body 126 that is removably connected to the lower body 122. The lower body 122 can have essentially the same structure as the lower body 22 described above, having a bottom wall 128, and an open mouth defined by an upper annular flared rim 132 that is provided at the top 130 of the lower body 122. The upper annular flared rim 132 has external threads 134.

The upper body 126 is also generally cylindrical with an inverted cup-like configuration, and has a lower annular flared rim 136 that has internal threads 138. The lower flared rim 136 has a slightly larger diameter than the upper flared rim 132 so that the lower flared rim 132 of the lower body 122 can be received inside the upper flared rim 136 of the upper body 126. The top of the upper body 126 has a slightly curved or convex surface 148 that defines a top wall 140. A generally circular first recess 137 extends from the top surface 148, and as best shown in FIGS. 11–15, a second recess 144 extends from the first recess 137 at a location that is offset from the center of the upper body 126 (see FIG. 13). The second recess 144 has a surrounding curved wall that defines a generally Figure-8 configuration. The top opening that leads into the second recess 144 can also have a generally Figure-8 configuration. An elongate opening 142 is provided at the bottom surface 178 of the second recess 144, and is also offset from the center of the upper body 126. The elongate opening 142 is adapted to receive a stopper, which can be any of the stoppers 50, 50*a*, 50*b* described above. The elongate opening 142 can also have a Figure-8 configuration. A pin slot 146 is provided in the surface of the first recess 137.

A lid 152 is pivotably secured to the upper body 126. The lid 152 can be provided with a generally circular configuration that is adapted to correspond to the configuration of the first recess 137, so that the lid 152 can be fitted inside the first recess 137 to provide a streamlined and flush top surface for the top of the upper body 126 when the lid 152 is closed. The lid 152 is positioned above the second recess 144 to cover the elongate opening 142 (and its stopper, if inserted).

The lid 152 has a top plate 154 with a protrusion 158 extending from the underside of the top plate 154. The protrusion 158 is configured with the same configuration as the second recess 144, but slightly smaller than the inner configuration of the second recess 144, so as to allow the lid 152 to be snugly secured to the second recess 144. A raised bump 156 can be provided on top of the lid 152 to facilitate gripping or pushing action by the user. A pin 159 is provided on the underside of the top plate 154 adjacent to the protrusion 158 near an end 161 of the lid 152.

The opposing end 160 of the lid 152 is pivotably connected (e.g., by a pivot pin 162) to a lateral side of the upper body 126 adjacent the top thereof. This pivoting connection allows the lid 152 to pivot about the pivot pin 162 from a completely closed position, shown in FIG. 10, in which the lid 152 completely encloses the second recess 144 and the stopper 50, 50*a* or 50*b*, to a completely opened position, shown in FIG. 11, in which the lid 152 is flipped open to expose the stopper 50, 50*a* or 50*b*. When the lid 152 is closed, the pin 159 is seated in the pin slot 146, and with the protrusion 158 snugly fitted inside the second recess 144, will together function to secure the lid 152 to the top of the upper body 126.

Figure 11:
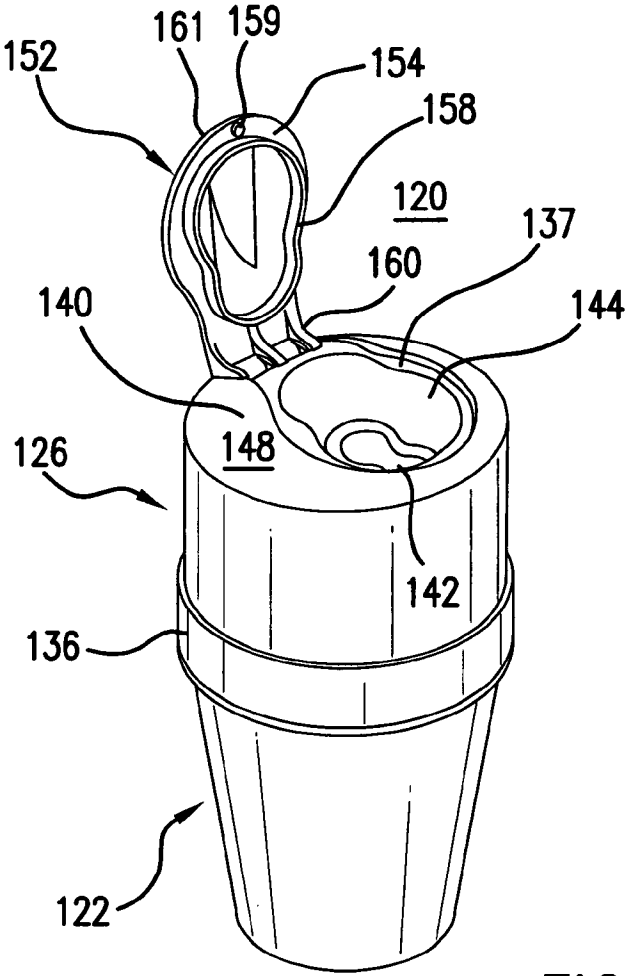
FIG. 11 is a perspective view of the container of FIG. 10 shown with the lid in the opened position.
Figure 10:
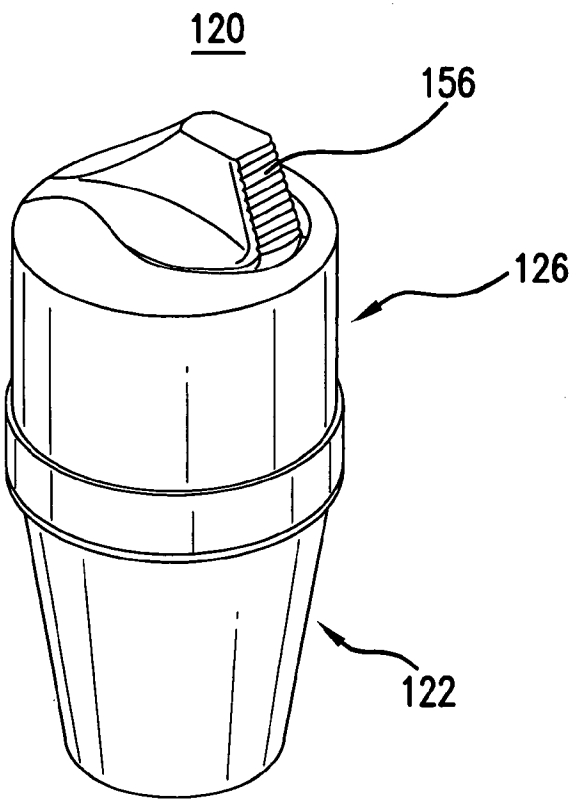
FIG. 10 is a perspective view of a non-spill container according to another embodiment of the present invention.
Figure 14:
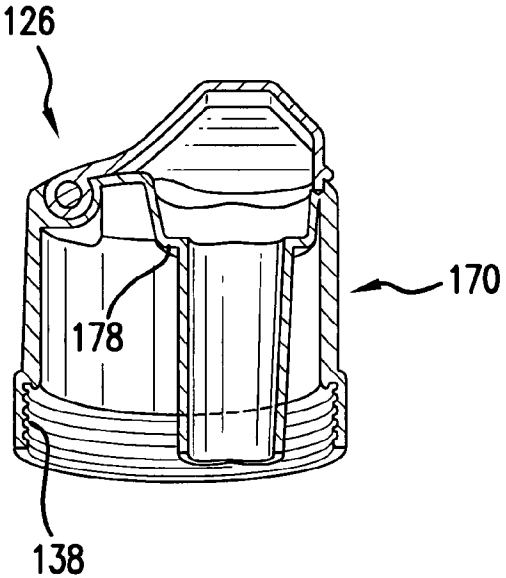
FIG. 14 is a cross-sectional view of the upper portion of the container of FIGS. 10–13.
Figure 13:
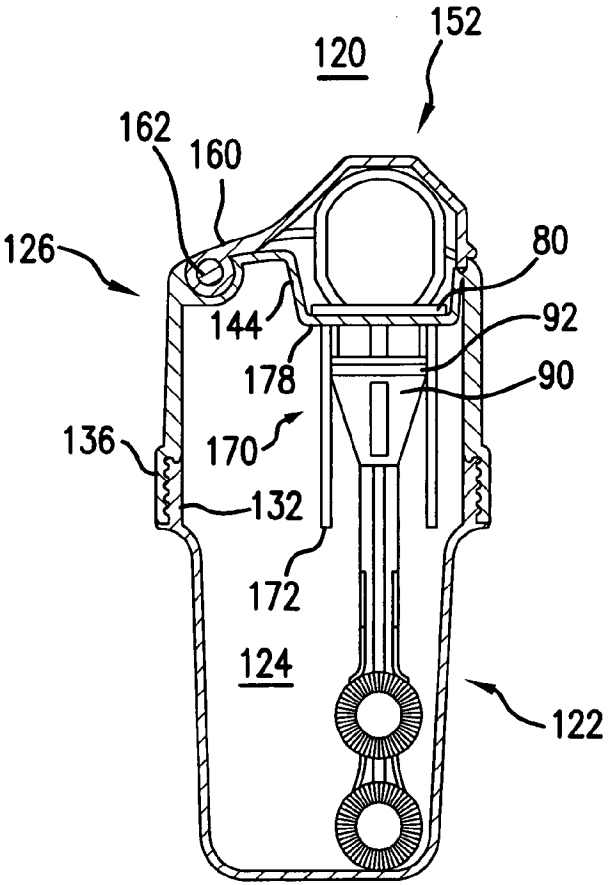
FIG. 13 is a side cross-sectional view of the container of FIG. 10.
Figure 12:
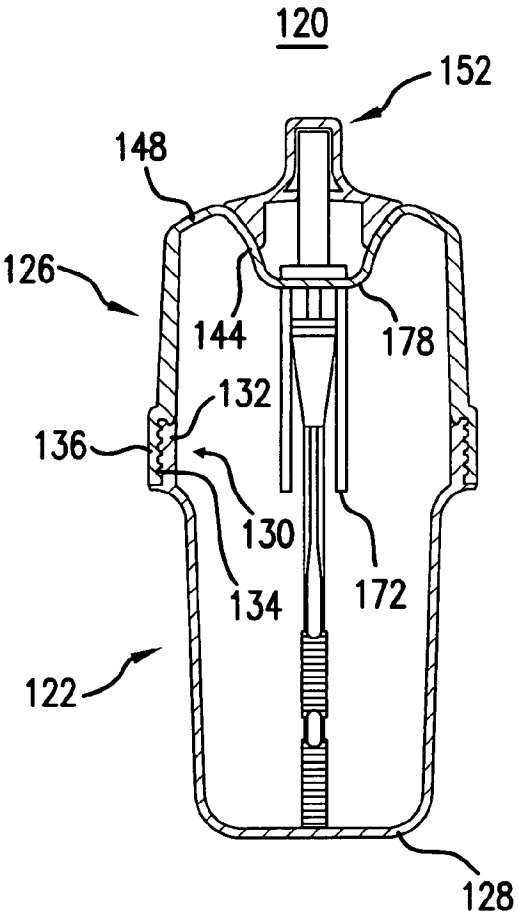
FIG. 12 is a front cross-sectional view of the container of FIG. 10.
Figure 17:
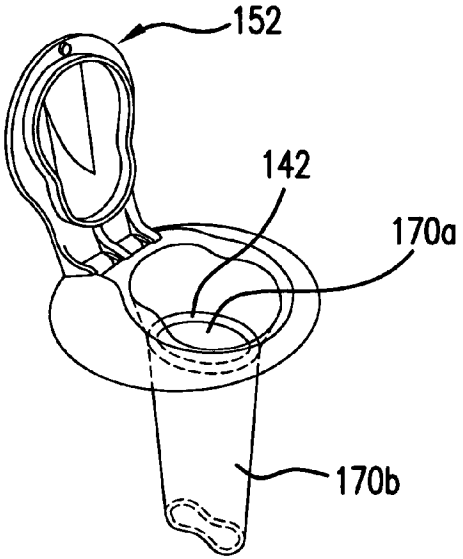
FIG. 17 is a perspective sectional view of another embodiment of the upper portion of the container of FIGS. 10–13.

A tube or funnel 170 extends from the opening 142 in the second recess 144 into the interior of the upper body 26. The tube 170 functions as a guide for the stopper 50. The tube 170 can have a generally Figure-8 cross-sectional configuration. Even though the tube 170 is illustrated as being generally Figure-8 in cross-section, it is possible to provide the tube 170 in any desired configuration. For example, the cross-sectional configuration of the tube 170 can be Figure-8 throughout the length of the tube 170 (as shown in FIGS. 11 and 14). Alternatively, as shown in FIG. 17, the cross-sectional configuration of the tube 170 can change, such as from a generally oval cross-section at the top (see 170*a*) adjacent the opening 42, and then gradually transition into a Figure-8 cross-section (see 170*b*) as the tube 170 extends into the interior of the container 120. The tube 170 can extend for any desired length into the interior of the container 120. For example, as shown in FIGS. 12 and 13, the tube 170 can extend for a length that is about the same as the length of the upper body 126, so that the lowermost end 172 of the tube 170 extends to the region where the rims 132 and 136 are located. Alternatively, the tube 170 can extend for a length that is less than the length of the upper body 126, or for a length that is greater than the length of the upper body 126 so that the lowermost end 172 is positioned inside the interior chamber 124 of the lower body 122.

The lower body 122 and the upper body 126 can be made from the same material, or from different materials. Possible materials for the lower body 122 and the upper body 126 can include plastic, acrylic, metal, glass or certain fabrics. The tube 170 and lid 152 can be molded or provided in one piece together with the upper body 126.

Figure 18:
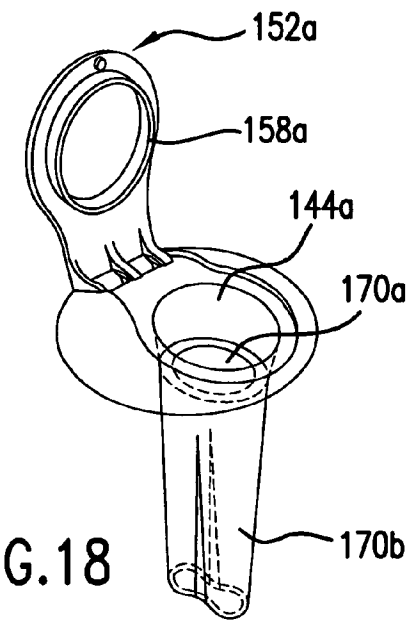
FIG. 18 is a perspective sectional view of yet another embodiment of the upper portion of the container of FIGS. 10–13.
Figure 15:
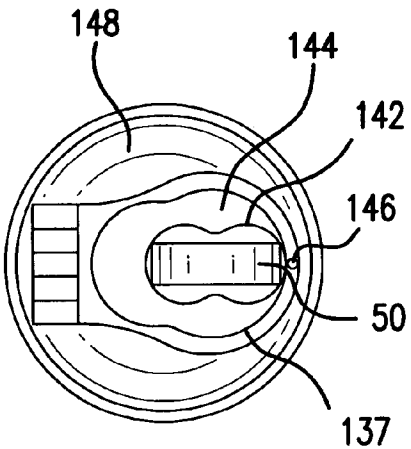
FIG. 15 is a top plan view of the container of FIG. 10 with the lid opened.
Figure 16:
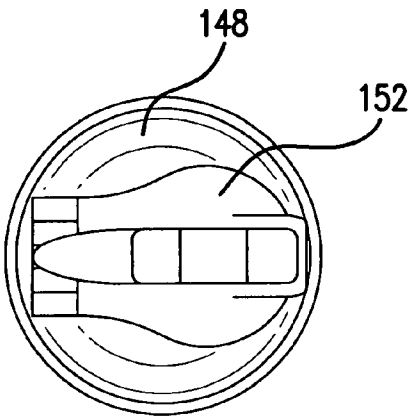
FIG. 16 is a top plan view of the container of FIG. 10 with the lid covering the opening.

FIG. 18 illustrates a possible modification to the container 120. In FIG. 18, the second recess 144*a* can be provided in a circular configuration (as opposed to the Figure-8 configuration of the second recess 144 in FIGS. 11 and 14). As a result, the protrusion 158*a* assumes a similar circular configuration to provide a snug fit with the second recess 144*a* when the lid 152*a* is closed.

In operation, the lower body 122 and upper body 126 are provided separately. Any liquid (e.g., bubble solution) can be filled into the interior chamber 124, and then the upper body 126 connected to the lower body 122 by engaging the threads 134 and 138 of the flared rims 132 and 136, respectively. The lid 152 is now pivoted to the opened position shown in FIG. 11. The wand 50 (which can be any of the stoppers 50*a*, 50*b*, 50*c* illustrated in FIGS. 9A–9C) is then inserted through the opening 142 so that the loops 82, 84 and a lower portion of the shaft 98 extend through the tube 170 and into the interior chamber 124 of the lower body 122, with the shoulder 90 and the lining 92 retained inside the tube 170 (see FIGS. 12 and 13). At this time, the extension 80 will engage the bottom surface 178 of the second recess 144, which acts as a stop surface to prevent the wand 50 from being inserted any further into the opening 142. The handle 94 is retained inside the second recess 144. At this time, the provision of the lining 92 inside the tube 170, coupled with the extension 80 engaging and covering the bottom surface 178, will prevent the liquid inside the container 120 from being leaked or spilled via the tube 170 and the opening 142. The lid 152 can now be pivoted to its closed position shown in FIG. 10, with the top plate 154 seated inside the first recess 137, and the pin 159 received inside the pin slot 146, so as to form a smooth and flush top surface for the upper body 126. The top plate 154 covers the wand 50, and more particularly, engages the top edge 100 of the handle 94 to keep the support section 88 securely positioned over the opening 142 as a further safeguard against leakage through the opening 142.

Where the tube 170 is provided with a changing cross-sectional configuration (e.g., from oval to Figure-8), the oval portion of the tube 170 will facilitate easier insertion of the loops 82, 84 and shaft 98, while the Figure-8 portion will provide a more secure fit of the stopper 50 inside the tube 170 to minimize the possibility of the stopper 50 coming loose. This feature further minimizes spillage or leakage of liquid stored inside the container 120.

To access the liquid stored inside the container 120, the user merely flips (i.e., pivots) open the lid 152 to the opened position shown in FIG. 11 by pushing on the bump 156. The user then grips the handle 94, and lifts the wand 50. If the liquid is a bubble solution, then the user can insert the wand 50 back through the opening 142 to access more of the bubble solution to create more bubbles. If the liquid is a medicine, the user can insert the medicine stopper 50 back through the opening 142 to access more of the medicine.

Although the present invention has been described in connection with the preferred embodiments, it will be appreciated by those skilled in the art that modifications can be made and alternatives utilized without departing from the spirit and scope of the present invention.

What is claimed is:

1. A bubble solution container assembly, comprising:

a lower container body that receives liquid therein and having a bottom wall and an open upper mouth;

an upper cylindrical body having a top wall and an open lower mouth, the top wall having a recess, and an opening provided in the recess, the upper body being removably connected to the lower body with the open mouths thereof in communication with each other to form an interior chamber;

a tube extending from the opening into the interior chamber; and a bubble wand having a shaft that includes a lower end, and a loop that is provided at the lower end of the shaft; and wherein the shaft of the bubble wand is inserted through the opening so that a portion of the shaft blocks the opening to prevent spillage of the liquid in the interior chamber.

2. The assembly of claim 1, further including:

a lid pivotably coupled to the top wall and covering the opening.

3. The assembly of claim 2, wherein the lid covers the bubble wand the lid is pivoted to a closed position.

4. The assembly of claim 2, wherein the lid pivots between a closed position with the lid covering the opening, and an opened position with the opening exposed.

5. The assembly of claim 2, wherein the lid has a top plate with an underside, and a protrusion extending from the underside of the top plate, the protrusion having the same configuration as the recess to be fitted inside the recess.

6. The assembly of claim 4, wherein the lid has a pin extending from the underside thereof, and the top wall further includes a pin slot provided thereon and receiving the pin therein when the lid is in the closed position.

7. The assembly of claim 2, wherein the recess is a second recess, and wherein the top wall further includes a first recess, with the second recess extending from the first recess, and with the first recess having the same configuration as the lid to receive the lid.

8. The assembly of claim 1, wherein the tube has a Figure-8 cross-section throughout its length.

9. The assembly of claim 1, wherein the tube has an upper portion and a lower portion, and wherein the upper portion has an oval cross-section and the lower portion has a Figure-8 cross-section.

10. The assembly of claim 1, wherein the recess has a Figure-8 configuration.

11. The assembly of claim 1, wherein the recess has a circular configuration.

12. A bubble solution container assembly, comprising:

a lower container body that receives liquid therein and having a bottom wall and an open upper mouth;

an upper cylindrical body having a top wall and an open lower mouth, the top wall having a recess that has a Figure-8 configuration, and an opening provided in the recess, the upper body being removably connected to the lower body with the open mouths thereof in communication with each other to form an interior chamber;

a bubble wand having a shaft that includes a lower end, and a loop that is provided at the lower end of the shaft; and wherein the shaft of the bubble wand is inserted through the opening so that a portion of the shaft blocks the opening to prevent spillage of the liquid in the interior chamber.

13. The assembly of claim 2, further including:

a lid pivotably coupled to the top wall and covering the opening.

* * * * *